US006681841B1

(12) United States Patent
Dale

(10) Patent No.: US 6,681,841 B1
(45) Date of Patent: Jan. 27, 2004

(54) BEVERAGE CHILLER

(76) Inventor: Kevin Dale, 55 King Street, Airport West, Victoria 3042 (AU)

( * ) Notice: Subject to any disclaimer, the term of this patent is extended or adjusted under 35 U.S.C. 154(b) by 0 days.

(21) Appl. No.: 09/744,557

(22) PCT Filed: Aug. 4, 1999

(86) PCT No.: PCT/AU99/00626

§ 371 (c)(1),
(2), (4) Date: Mar. 23, 2001

(87) PCT Pub. No.: WO00/07929

PCT Pub. Date: Feb. 17, 2000

(30) Foreign Application Priority Data

Aug. 4, 1998 (AU) ..... PP5026

(51) Int. Cl.[7] ..... F28F 3/14; F28F 3/12

(52) U.S. Cl. ..... 165/47; 165/167; 165/166; 165/165; 165/168; 62/398; 222/146.6

(58) Field of Search ..... 165/164, 165, 165/166, 167, 66, 168, 169, 47; 62/398, 396; 222/146.6

(56) References Cited

U.S. PATENT DOCUMENTS

| | | | | | |
|---|---|---|---|---|---|
| 1,770,254 | A | * | 7/1930 | Seligman | 165/103 |
| 1,828,477 | A | * | 10/1931 | Seligman | 165/164 |
| 1,961,660 | A | * | 6/1934 | Fehrman | 165/166 |
| 1,992,097 | A | * | 2/1935 | Seligman | 165/167 |
| 2,056,581 | A | * | 10/1936 | Mortensen | 165/164 |
| 2,160,928 | A | * | 6/1939 | Voorhees | 165/167 |
| 2,191,044 | A | * | 2/1940 | Seligman | 165/167 |
| 2,300,663 | A | * | 11/1942 | Fette | 165/167 |
| 2,324,707 | A | * | 7/1943 | Johnson | 165/164 |
| 2,424,792 | A | * | 7/1947 | Blum | 62/396 |
| 2,430,774 | A | * | 11/1947 | Lynn | 165/164 |
| 2,616,671 | A | * | 11/1952 | Wakeman | 165/167 |
| 3,228,465 | A | * | 1/1966 | Vadot | |
| 3,255,817 | A | * | 6/1966 | Davids et al. | 165/166 |
| 3,404,733 | A | * | 10/1968 | Pottharst, Jr. | 165/166 |
| 3,858,627 | A | * | 1/1975 | Hinxlage | 165/66 |
| 4,150,719 | A | * | 4/1979 | Thielen et al. | 165/140 |
| 4,291,546 | A | * | 9/1981 | Rodth | 62/398 |
| 4,403,652 | A | * | 9/1983 | Schiltz et al. | 165/167 |
| 4,651,538 | A | * | 3/1987 | Bull et al. | 62/398 |
| 4,678,104 | A | | 7/1987 | Pritchett | |
| 4,744,414 | A | * | 5/1988 | Schon | 165/167 |
| 4,958,505 | A | * | 9/1990 | Swanson | 62/398 |
| 5,996,842 | A | * | 12/1999 | Riley et al. | 222/146.1 |
| 6,155,069 | A | * | 12/2000 | Quartarone et al. | 62/344 |

FOREIGN PATENT DOCUMENTS

| | | | | |
|---|---|---|---|---|
| BE | 892237 | | 6/1982 | |
| DE | 585800 | * | 10/1933 | 165/170 |
| FR | 780167 | * | 4/1935 | 62/398 |
| GB | 413811 | * | 7/1934 | 165/167 |
| GB | 487840 | * | 6/1938 | 165/166 |
| GB | 1009178 | * | 11/1965 | 165/164 |
| JP | 9-322841 A | | 12/1997 | |
| WO | WO 0000 766 | * | 10/1979 | 165/164 |

* cited by examiner

*Primary Examiner*—John K. Ford
(74) *Attorney, Agent, or Firm*—Edwin D. Schindler

(57) ABSTRACT

A fluid delivery cooling system which includes at least one cooling plate containing at least one fluid delivery line, said cooling plate being contacted on either side thereof by a gasket containing coolant channels.

4 Claims, 3 Drawing Sheets

BEVERAGE CHILLER

TECHNICAL AREA

This invention relates to apparatus for cooling beverages and in particular beverages such as beer which are delivered through conduits or lines from remote storage areas when supplied in the hospitality industry.

Although the invention may relate to cooling of all manner of "on line" delivered beverages the discussion herein will, for convenience, be in terms of the delivery of beer.

BACKGROUND TO THE INVENTION

In the hospitality industry beer is customarily stored in barrels and delivered along lines of tubing to its outlet point, presumably at a bar.

Clearly there must be some provision for cooling the beer at some stage of its delivery in order that it be served at a temperature considered desirable to the customer.

Many systems have existed in the past for cooling individual lines of beer however, in recent times where many different types of beer may need to be provided on tap simultaneously, a requirement has arisen that such cooling should take place close to the outlet point to avoid duplication of cooling systems.

Cooling systems do exist whereby cooling plates are manufactured which contain lines of a coolant which act as heat exchangers with lines carrying beer. It is relatively difficult to control the precise temperature at which the beer is delivered however especially when demand can vary greatly at different times during a day.

Another problem associated with such cooling plates is that the size of the plate system required is dependent on the number of types of beer required to be on tap and once a system is developed for a specific number of beer outlets the cooling system is inflexibly arranged and the number of outlets cannot be varied.

From a marketing point of view there is a further problem with existing beer supply systems in that the flavour of different beers are best at their own optimum temperatures and it may therefore be desirable for different beers to be dispensed at different temperatures. The public however tends to perceive that it is desirable for beer to be well chilled, perhaps close to freezing, at which temperature much of the flavour is lost. It is therefore desirable that beer should appear to be dispensed at these temperatures by providing a frosted delivery font while maintaining rather than varying the temperature of the beer.

SUMMARY OF THE INVENTION

It is an object of this invention to provide a beer cooling system which delivers beer to an outlet at the desired temperature but which can be adapted to accommodate more or less beer lines.

It is also an object of this invention to provide a means whereby beer can be dispensed at its optimum temperature while appearing well chilled.

The invention is a fluid delivery cooling system which includes at least one cooling plate containing at least one fluid delivery line, said cooling plate being contacted on either side thereof by a gasket containing coolant channels.

It is preferred that the cooling system be provided with end plates which are interconnected through successive gaskets and cooling plates such that multiple cooling plates and gaskets can be assembled by the connection of the end plates at the extremities of any assembly. It is preferred that this connection be effected by bolts.

The invention also includes an outlet means to a dispensing point which outlet means is chilled by the coolant such that condensation or ice can form on it but the beer dispensed passes through an insulating tube internal to the outlet means and is maintained at its optimum temperature.

It is preferred that a cooling plate should have more than one fluid delivery line cast into the cooling plate which plate is preferably of some material having good thermal conductivity such as aluminium.

It is also preferred that each cooling plate be provided with either a coolant entry or exit tube or both, which tube accesses a bore in the cooling plate and permits coolant to pass through the fluid delivery cooling system through one gasket to another.

It is also preferred that a temperature sensing device be located in the cooling plate, preferably close to a fluid delivery line, and a solenoid valve controlled by the temperature sensing device be located between the coolant inlet and outlet tubes of plates which are to be maintained at the same temperature such that coolant flow ceases if the sensed temperature is lower than a preset value.

It is further preferred that the gaskets be located on the cooling plates by the provision of pins, preferably of stainless steel on the sides of the cooling plates.

In order that the invention may be more readily understood a specific embodiment of it will be described by way of non limiting example with reference to the accompanying drawings.

BRIEF DESCRIPTION OF THE DRAWING FIGURES

DETAILED DESCRIPTION OF EMBODIMENTS OF THE INVENTION

In a preferred embodiment of the invention the fluid delivery cooling system 10 includes individual cooling plates 20 with good thermal conductivity, preferably of a metal such as cast aluminium, and having beer lines having an input 21 and an output 22 embedded in them.

Figure 1:
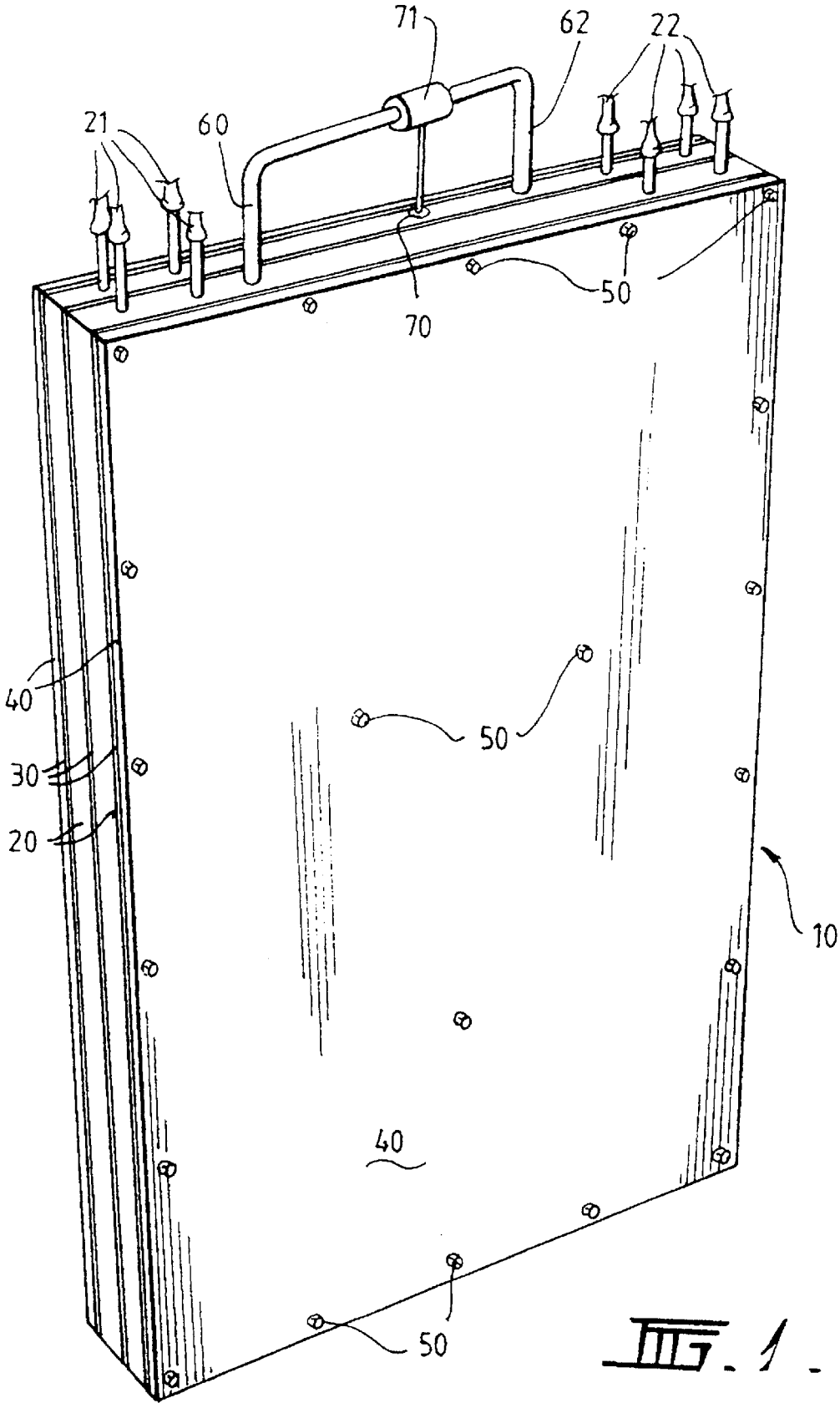
FIG. 1 is a perspective view of a cooling system having two cooling plates.

In the embodiment shown in FIG. 1 the cooling system is made up of two such cooling plates 20 separated from each other and end plates 40 by gaskets 30. Bolts 50 pass through the assembly and maintain it as a unitary object.

Figure 2:
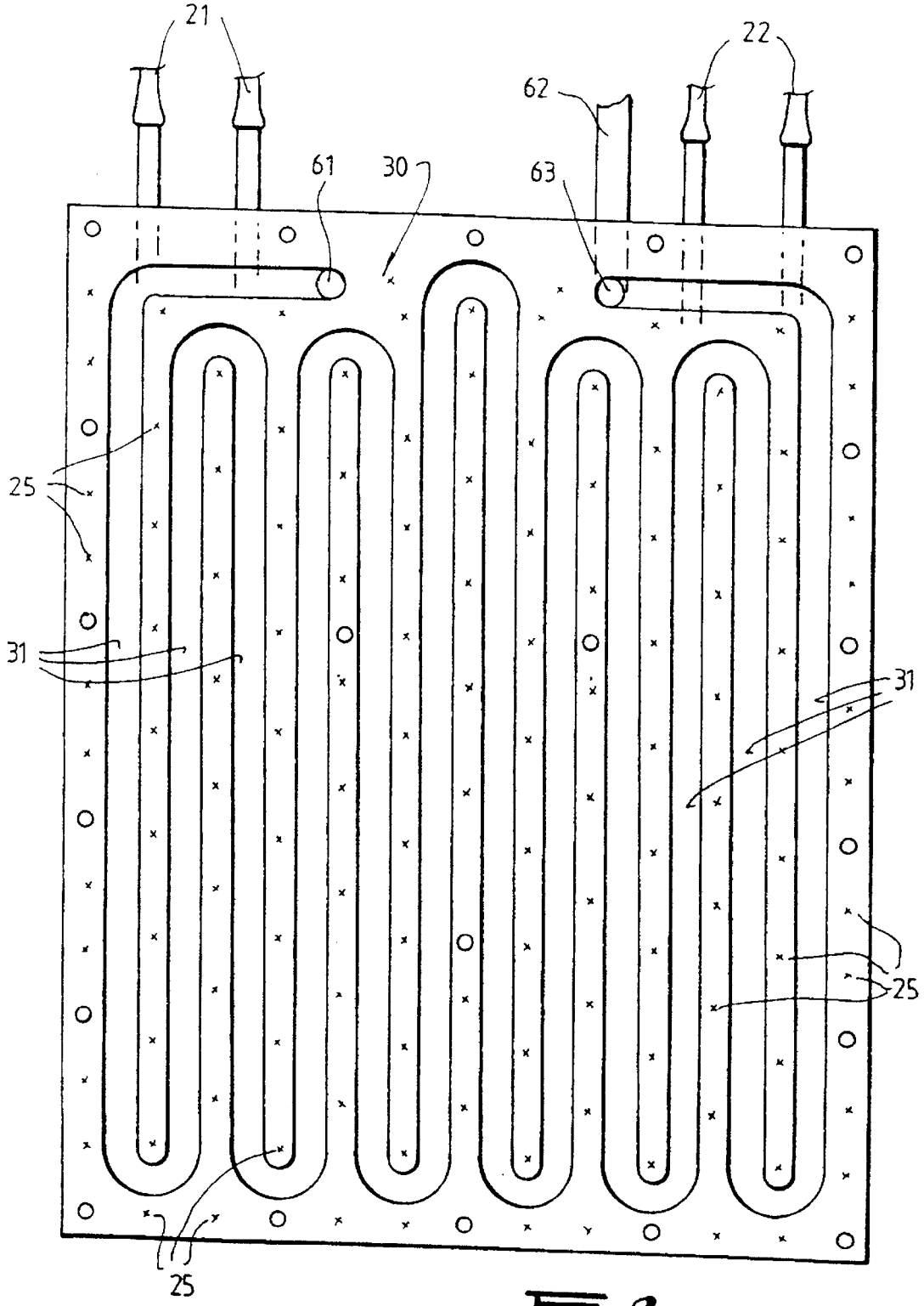
FIG. 2 shows a gasket located on one side of a cooling plate.
Figure 3:
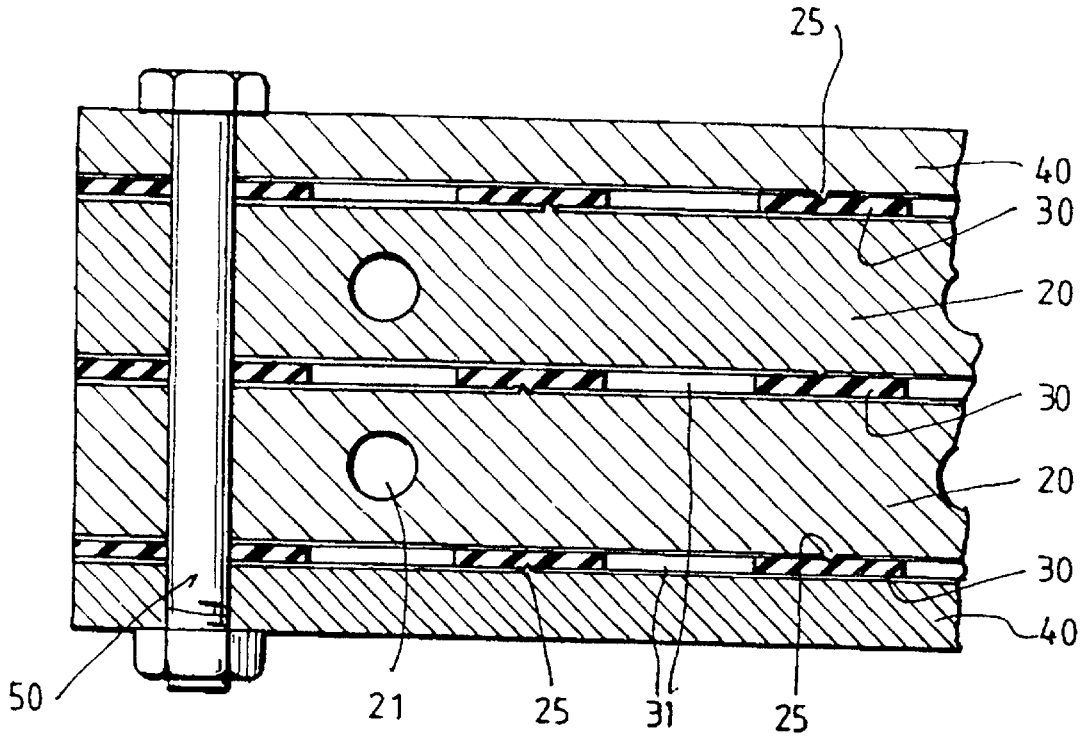
FIG. 3 is a partial cross-section through a cooling system showing gaskets and two cooling plates bolted together through end plates.

FIG. 2 shows a gasket 30 located on an exterior face of a cooling plate by stainless steel pins 25. These gaskets 30 are preferably of 3 mm to 4 mm thick rubber and have internal channels 31 through which coolant can pass.

As shown in FIG. 2 coolant can pass into a tubular entry 60 in the top of a cooling plate 20 into a bore 61 through both the gasket 30 and the cooling plate 20 and flow around the resulting channel and pass out though another bore 62 through cooling plate 20 to the next gasket and so on to exit through a tube 62 in an adjacent plate.

Where only one cooling plate is used the coolant inlet and outlet would of course be in the same plate. Where three or more cooling plates are manifolded together, and are to be maintained at the same temperature, it is envisaged that the outermost cooling plates would have either an inlet or an outlet tube.

The number of plates used of course depends on the number of beer lines required and the temperatures which are to be maintained for each type of beer. Clearly it is a simple matter to assemble cooling systems in multiples of pairs of cooling plates of the type shown, an array of single units or a multiplicity thereof.

The commonality of coolant circulating between the plates is determined by the temperature required for the respective beer lines.

In this preferred embodiment of the invention there are two beer lines per cooling plate. The beer temperature is measured by a temperature probe 70, for example a resistance thermometer although any means may be used, which may be inserted into an aperture formed in a cooling plate adjacent a beer line.

The output from this temperature sensor 70 can be used to operate a solenoid valve 71 located between coolant inlet 60 and outlet 62, which coolant valve 71 opens so that the coolant path through the plate is bypassed and so that coolant flow through the plate is substantially reduced once the beer has been cooled to a preset temperature thereby suppressing further cooling. Once the beer reaches an upper preset temperature the valve can close and coolant flow through the plate recommences.

The coolant temperature is below 0° C. as it is preferable to have only one coolant source for both cooling the beer and the outlet means. As the temperature sensors control a valve in each inlet line which adjusts the coolant flow rate through the gasket and hence the degree of cooling of the relevant beer the temperature of the coolant can be substantially less than the required beer temperature.

The beer then enters its outlet means and passes to its dispensing point. At least part of the outlet means, and in particular that adjacent the dispensing point, is lined with nylon or any other appropriate insulator to maintain the beer at the temperature at which it leaves its plate.

An area between the insulating beer delivery tube and the inside of the outlet means is flooded with the coolant so that it becomes very chilled and condensation or ice forms on the outside of this outlet means. The beer however has little thermal contact with the coolant at this delivery stage and hence maintains its desired temperature.

By this process a drinker perceives the beer as being extremely well chilled, which is aesthetically desirable, while the beer is served at its optimum temperature for taste.

It is envisaged that other embodiments of the invention will exhibit any number of and any combination of the features previously described and whilst we have described herein specific embodiments of the invention it is to be understood that variations and modifications in this can be made without departing from the scope thereof.

The claims defining the invention are as follows:

1. A fluid delivery cooling system, comprising:

a cooling plate containing at least one fluid delivery line embedded within said cooling plate;

a gasket contacting said cooling plate on either side of said cooling plate;

end plates; and, fastening means for holding said end plates together, said fastening means passing through said end plates and passing through said cooling plate and said gasket so arranged between said end plates, with said end plates or said cooling plate adjacent each side of said gasket defining a coolant channel passing through said gasket.

2. The fluid delivery cooling system according to claim 1, further comprising coolant passing through said coolant channel in said gasket on one side of said cooling plate and through an aperture in said cooling plate for circulating through said coolant channel in said gasket on an opposite side of said cooling plate.

3. A fluid delivery cooling system, comprising:

a plurality of cooling plates with each cooling plate of said plurality of cooling plates containing at least one fluid delivery line embedded within said cooling plate;

a plurality of gaskets with a gasket of said plurality of gaskets contacting each said cooling plate on either side of said cooling plate;

end plates; and, fastening means for holding said end plates together, said fastening means passing through said end plates and passing through said plurality of cooling plates and said plurality of gaskets so arranged between said end plates, with said end plates or each said cooling plate adjacent each side of each said gasket for defining a coolant channel passing through each said gasket.

4. The fluid delivery cooling system according to claim 3, further comprising coolant passing through said coolant channel in a first gasket of said plurality of gaskets on one side of each said cooling plate and through an aperture in each said cooling plate for circulating through said coolant channel in a second gasket of said plurality of gaskets on an opposite side of each said cooling plate.

* * * * *